US008459449B2

(12) United States Patent
Justice et al.

(10) Patent No.: US 8,459,449 B2
(45) Date of Patent: Jun. 11, 2013

(54) EASY-OPENING CARTON FOR SHIPPING AND STORING CUT PAPER

(75) Inventors: Timothy J. Justice, Williston, TN (US); Wayne H. Kuhn, Palos Park, IL (US); Charles T. Strominger, Stillman Valley, IL (US); Ronald F. Schmitz, Mt. Washington, KY (US)

(73) Assignee: International Paper Company, Memphis, TN (US)

( * ) Notice: Subject to any disclaimer, the term of this patent is extended or adjusted under 35 U.S.C. 154(b) by 1175 days.

(21) Appl. No.: 11/580,515

(22) Filed: Oct. 13, 2006

(65) Prior Publication Data

US 2007/0199837 A1 Aug. 30, 2007

Related U.S. Application Data

(63) Continuation-in-part of application No. 11/445,446, filed on Jun. 1, 2006, now Pat. No. 7,798,317.

(60) Provisional application No. 60/772,468, filed on Feb. 10, 2006, provisional application No. 60/698,156, filed on Jul. 11, 2005, provisional application No. 60/686,211, filed on Jun. 1, 2005.

(51) Int. Cl.
*B42F 7/14* (2006.01)

(52) U.S. Cl.
USPC ..... 206/215; 229/117.24; 229/211; 229/123; 220/770

(58) Field of Classification Search
USPC ..... 206/215, 750, 757, 766, 45.21, 45.22, 206/45.23, 772, 773, 774, 549, 555, 425, 206/141, 200, 428, 510; 229/122.21, 122.27, 229/122.32, 225, 237, 117.24, 122, 125.19, 229/145, 117.09, 117.23, 117.13, 117.14, 229/117.15, 117.19, 117.11, 117.22, 125.41, 229/125.33, 211, 228, 123; 248/693; 493/88; 294/150, 137, 138; 220/694, 752, 754, 755, 220/759, 760, 762, 767, 769, 770, 776, 768
See application file for complete search history.

(56) References Cited

U.S. PATENT DOCUMENTS 692,301 A * 2/1902 Kane ..... 229/117.01
715,127 A 2/1902 Norton (Continued)

FOREIGN PATENT DOCUMENTS

CH 660345 4/1987
DE 8809938 11/1988

(Continued)

OTHER PUBLICATIONS

EP 1170221 English

*Primary Examiner* — Jacob K Ackun
*Assistant Examiner* — Jennie Pagan
(74) *Attorney, Agent, or Firm* — Matthew M. Eslami

(57) ABSTRACT

An easy to carry lightweight carton for shipping and storing cut paper and for providing rapid and easy access to the paper when the carton is opened. The carton has a base portion and a lid pivotally attached to the base portion. A front wall of the carton may be pivoted down when the lid is pivoted up to facilitate access to the contents of the carton for ease of unloading of paper from the carton. A carry handle is built into the lid to facilitate carrying of the carton. The carton may be re-closed after it is opened.

14 Claims, 7 Drawing Sheets

U.S. PATENT DOCUMENTS

| | | | | | |
|---|---|---|---|---|---|
| 1,057,145 | A | | 3/1913 | Hagan | |
| 1,216,071 | A | | 2/1917 | Carstensen | |
| 1,271,542 | A | | 7/1918 | Crenshaw | |
| 1,707,969 | A | | 4/1929 | Paulson | |
| 1,724,636 | A | * | 8/1929 | Bell | 229/112 |
| 2,180,691 | A | | 11/1939 | Olivier | |
| 2,354,543 | A | * | 7/1944 | Ratcliff | 229/102 |
| 2,364,829 | A | * | 12/1944 | Tichenor | 229/165 |
| 2,639,082 | A | | 5/1953 | Goldsmith | |
| 2,667,297 | A | | 1/1954 | McReary | |
| 2,680,558 | A | | 6/1954 | Mai | |
| 2,695,128 | A | | 11/1954 | Rendall | |
| 2,721,022 | A | | 10/1955 | Billerbeck | |
| 2,795,369 | A | | 6/1957 | Caster et al. | |
| 2,797,039 | A | | 6/1957 | Belsinger | |
| 3,015,430 | A | | 1/1962 | Bauer | |
| 3,040,957 | A | * | 6/1962 | Meyers | 229/228 |
| 3,058,583 | A | | 10/1962 | Williams | |
| 3,065,897 | A | | 11/1962 | Grapp | |
| 3,109,577 | A | | 11/1963 | Knipp | |
| 3,146,936 | A | | 9/1964 | Hodapp | |
| 3,206,096 | A | | 9/1965 | Struble | |
| 3,216,645 | A | * | 11/1965 | Hemann | 229/117.13 |
| 3,231,172 | A | | 1/1966 | Strange | |
| 3,235,167 | A | | 2/1966 | Svensson | |
| 3,237,842 | A | | 3/1966 | Esse | |
| 3,307,770 | A | | 3/1967 | Wysocki | |
| 3,318,508 | A | | 5/1967 | Buttery | |
| 3,326,369 | A | | 6/1967 | Tolaas | |
| 3,361,328 | A | * | 1/1968 | Buttery | 229/227 |
| 3,372,856 | A | | 3/1968 | Erhart | |
| 3,410,476 | A | | 11/1968 | Buttery et al. | |
| 3,441,193 | A | | 4/1969 | Castle | |
| 3,542,281 | A | * | 11/1970 | Field et al. | 383/21 |
| 3,603,501 | A | | 9/1971 | Confer | |
| 3,638,853 | A | | 2/1972 | Perry | |
| 3,648,921 | A | | 3/1972 | Lock | |
| 3,684,158 | A | | 8/1972 | Harris | |
| 3,712,531 | A | | 1/1973 | McCall | |
| 3,747,833 | A | * | 7/1973 | Robinson | 229/221 |
| 3,797,728 | A | | 3/1974 | Buttery et al. | |
| 3,801,012 | A | * | 4/1974 | Thelen | 229/117.22 |
| 3,831,834 | A | | 8/1974 | Elward | |
| 3,858,720 | A | | 1/1975 | Flagler | |
| 3,863,834 | A | | 2/1975 | Sandford | |
| 3,870,222 | A | * | 3/1975 | Butler | 229/125.03 |
| 3,963,173 | A | | 6/1976 | Stone | |
| 4,008,849 | A | | 2/1977 | Baber | |
| 4,066,205 | A | * | 1/1978 | Griffith | 229/221 |
| 4,113,102 | A | | 9/1978 | Mueller | |
| 4,295,599 | A | * | 10/1981 | Locatelli et al. | 206/737 |
| 4,361,236 | A | | 11/1982 | Lavery | |
| 4,386,705 | A | | 6/1983 | Meuller | |
| 4,498,620 | A | * | 2/1985 | Dickert et al. | 229/117.24 |
| 4,512,477 | A | | 4/1985 | Densen | |
| 4,583,679 | A | | 4/1986 | Johnson | |
| 4,583,681 | A | * | 4/1986 | Neese | 229/117.22 |
| 4,637,544 | A | | 1/1987 | Quercetti | |
| 4,753,348 | A | | 6/1988 | Patrick et al. | |
| 4,778,057 | A | | 10/1988 | Allen et al. | |
| 4,834,242 | A | | 5/1989 | Selack et al. | |
| 4,844,262 | A | | 7/1989 | Patrick et al. | |
| 4,858,414 | A | | 8/1989 | Meschi | |
| 4,871,067 | A | | 10/1989 | Valenti | |
| 4,925,019 | A | | 5/1990 | Ganz et al. | |
| 4,951,824 | A | | 8/1990 | Kuchenbecker et al. | |
| 4,955,925 | A | | 9/1990 | Platti | |
| 4,964,511 | A | | 10/1990 | Meschi | |
| 5,036,982 | A | | 8/1991 | Aston | |
| 5,105,950 | A | * | 4/1992 | Gottfreid et al. | 229/210 |
| 5,176,313 | A | | 1/1993 | Curry et al. | |
| 5,198,276 | A | | 3/1993 | Nakajima | |
| 5,259,631 | A | | 11/1993 | Brande | |
| 5,325,989 | A | | 7/1994 | Karalus | |
| 5,348,147 | A | | 9/1994 | Gottfreid | |
| 5,413,273 | A | | 5/1995 | Money | |
| 5,417,366 | A | * | 5/1995 | Hanko et al. | 229/227 |
| 5,439,168 | A | * | 8/1995 | Kim | 229/225 |
| 5,458,272 | A | | 10/1995 | Ward-Weber | |
| 5,487,506 | A | | 1/1996 | Drummond et al. | |
| 5,505,372 | A | | 4/1996 | Edson et al. | |
| 5,622,309 | A | | 4/1997 | Matsuda et al. | |
| 5,657,872 | A | | 8/1997 | Leftwich et al. | |
| 5,738,274 | A | | 4/1998 | Stude | |
| 5,794,770 | A | | 8/1998 | Plomgren et al. | |
| 5,813,597 | A | | 9/1998 | Wakevainen | |
| 5,890,650 | A | * | 4/1999 | Penson | 229/243 |
| 5,988,370 | A | | 11/1999 | Roemer et al. | |
| 6,016,911 | A | | 1/2000 | Chen | |
| 6,073,760 | A | * | 6/2000 | Roemer et al. | 206/215 |
| 6,227,444 | B1 | | 5/2001 | Makoesky et al. | |
| 6,332,538 | B1 | * | 12/2001 | Pritchard | 206/524.3 |
| 6,352,157 | B1 | | 3/2002 | Srinivasan | |
| 6,422,454 | B1 | | 7/2002 | Barr | |
| 6,578,736 | B2 | | 6/2003 | Spivey | |
| 6,715,639 | B2 | | 4/2004 | Spivey | |
| 6,789,673 | B2 | | 9/2004 | Lingamfelte | |
| 6,923,365 | B2 | | 8/2005 | Auclair et al. | |
| 6,964,520 | B1 | | 11/2005 | Sakai et al. | |
| 7,066,321 | B2 | * | 6/2006 | Kawaguchi et al. | 206/77.1 |
| 7,140,493 | B2 | | 11/2006 | Fry | |
| 7,367,490 | B2 | | 5/2008 | Forthaus et al. | |
| 7,798,317 | B2 | | 9/2010 | Justice et al. | |
| 2002/0000463 | A1 | | 1/2002 | Jaggi | |
| 2002/0134824 | A1 | | 9/2002 | Mills | |
| 2002/0166889 | A1 | | 11/2002 | Makofsky et al. | |
| 2003/0116613 | A1 | | 6/2003 | McLeod et al. | |
| 2003/0226783 | A1 | | 12/2003 | Jackson et al. | |
| 2003/0234284 | A1 | | 12/2003 | Chiera | |
| 2004/0045857 | A1 | | 3/2004 | Gillani | |
| 2004/0124234 | A1 | * | 7/2004 | Forthaus et al. | 229/117.24 |
| 2004/0232039 | A1 | | 11/2004 | Daniels | |
| 2005/0011941 | A1 | * | 1/2005 | Ruhbusch et al. | 229/225 |
| 2005/0051573 | A1 | | 3/2005 | Crossland et al. | |
| 2006/0118605 | A1 | * | 6/2006 | Justice et al. | 229/117.13 |
| 2007/0199837 | A1 | | 8/2007 | Justice et al. | |
| 2008/0237070 | A1 | | 10/2008 | Justice | |
| 2011/0297561 | A1 | | 12/2011 | Justice | |

FOREIGN PATENT DOCUMENTS

| | | |
|---|---|---|
| DE | 19918991 | 11/2000 |
| DE | 102004006056 | 9/2005 |
| EP | 0235852 | 3/1991 |
| EP | 0235852 | 4/1991 |
| EP | 0844188 B1 | 5/1998 |
| EP | 0726205 | 10/1998 |
| EP | 1136372 | 9/2001 |
| EP | 1170221 | 9/2002 |
| EP | 1360116 | 2/2006 |
| FR | 1.277.491 | 8/1960 |
| FR | 2579563 | 2/1990 |
| GB | 1545469 | 5/1979 |
| GB | 2281065 | 2/1995 |
| PL | 185153 | 3/2003 |
| PL | 189871 | 10/2004 |
| PL | 65832 | 1/2011 |
| WO | 9533665 | 12/1995 |
| WO | WO 2006/060703 | 6/2006 |
| WO | 2008124193 | 10/2008 |

* cited by examiner

EASY-OPENING CARTON FOR SHIPPING AND STORING CUT PAPER

CROSS-REFERENCE TO RELATED APPLICATIONS

This application is a continuation-in-part of U.S. patent application Ser. No. 11/445,446, filed Jun. 1, 2006, which in turn claims the benefit of U.S. provisional patent application Ser. No. 60/772,468, filed on 10 Feb. 2006, U.S. provisional patent application Ser. No. 60/698,156, filed on 11 Jul. 2005, and U.S. provisional patent application Ser. No. 60/686,211, filed on 1 Jun. 2005, all of which are hereby incorporated hereinto by reference as if fully restated herein.

BACKGROUND OF THE INVENTION

1. Technical Field of the Invention

This invention relates to packaging, and especially to a package for paper products. More particularly, the invention relates to a shipping and storage carton for cut sheets of paper, wherein the carton has a size and weight to promote easy handling and storage and has an easy-opening feature including a fold-down side to facilitate access to the paper. The carton may be reclosed after opening to keep unused paper fresh and neatly stacked, and has a built-in handle for ease and convenience in carrying the carton.

2. Brief Description of the Related Art

Cut-sized paper, such as conventional photocopy paper, typically is wrapped in reams each containing, for example, 500 sheets. It is common for a plurality of reams to be bundled together and packaged in a corrugated container for shipping, storage and handling. For example, it is common to package from five to ten reams of paper in a single container, with a lid secured over the container to keep the reams from falling out of the container during shipping and handling. Since a single ream of paper weighs about five pounds, packages containing from five to ten reams of paper are heavy and difficult to handle. Moreover, they are relatively large and require substantial storage space. Further, the reams of paper are closely surrounded by the container walls, and the lack of space between the reams of paper and the container walls makes it difficult to remove the reams of paper for use. Additionally, each ream must be individually opened to gain access to the paper, and the ream wrap disposed of.

Single wrapped reams of paper also are commonly sold, and although these packages are easy to handle and store, they do not protect the paper from physical damage. Further, most equipment used in the home or in small offices does not hold a full ream of paper. Consequently, after a ream is opened and the desired amount of paper removed, the remaining unused paper is unprotected.

Many home and small office users prefer to purchase several reams of paper at once, rather than to buy single reams more frequently, but prefer not to buy as many as ten reams at once. Packages have been developed that hold five reams of paper, but even these packages are heavy, and, as such, are more suitable for industrial and commercial purchasers, which typically will have material handling equipment such as power lifts and hand carts to handle such heavy items. Average home users who wish to purchase several reams of paper at once typically do not have access to such material handling equipment.

Unwrapped cut sheets of paper are sometimes packaged loose in cartons designed to closely fit the paper and protect it from damage. Unwrapped cut sheets of paper do not require removal and discarding of ream wrap, but conventional cartons of this type generally are also sized to hold from five to ten reams of paper and thus are relatively difficult to handle and store. Moreover, these cartons generally have either a removable lid or foldable flaps to close the top of the carton, and the lid is removed or the flaps opened to form an open top through which product is removed from the carton. With such packaging it is difficult to remove the contents without damaging the carton or inverting it to pour the contents out because of the lack of space to insert the hands of the user between the side walls of the carton and the paper stored therein.

Additionally, and particularly for the larger containers that are commonly used for shipping and storing cut sheets of paper, it is common for the stacks of paper to stand taller than the container base sidewalls, whereby the lid actually rests upon the top of the stacks rather than on the upper ends of the container sidewalls. Because it is common for several containers to be stacked on top of one another during shipping, reams of paper packed in the stacked containers typically compress as air that was trapped between the individual sheets within the reams during the wrapping process is "squeezed" out. As a result, it is not uncommon for the containers to be compressed as the stacks of reamed paper compress. That is, as the individual reams compress, it is not uncommon for the containers to become "less tall" by virtue of the fact that the container lid (which rests upon the top of the paper stacks) moves closer towards the container base. For this reason, paper suppliers prefer not to secure the lids directly to the container bases using an adhesive because the shear strength of typical hot melt adhesives cannot withstand the shear strain resulting from movement of the lid relative to the container base. In such situations, the lids become disassociated from the container bases, thereby permitting the reams of paper to spill out of the container. Free lids also become entangled in automated material handling equipment, thereby causing machine shut downs and shipping inefficiencies. Thus, it has become common to utilize ancillary securing devices, such as straps and the like, rather than or in addition to adhesive, to hold such container lids onto their respective bases. However, such devices do not always prevent the lids from becoming disassociated from the bases. For example, as the containers are compressed (for the reasons described above), the straps are loosened and are free to slip either partially or entirely off of the container, allowing the lids to become disassociated from the bases, resulting in product spillage and/or damage. In addition to the free lids (which may become entangled in material handling equipment), the free straps may likewise become entangled in the material handling equipment, resulting in machine shut downs and shipping inefficiencies. Operator safety is also reduced, as the free straps and free lids clutter the workspace.

It is desirable therefore to provide a carton for shipping and storing sheets of paper, such as photocopy paper or the like, which not only is smaller and lighter in weight than conventional multi-ream containers and accordingly is easier to handle and store, but which also protects the paper against physical damage from the environment.

It is also desirable to provide a carton that enables the sheets of paper to be easily and quickly unloaded from the carton, wherein the carton is adapted to remain sealed during shipping, handling and storing operations without the need to utilize ancillary securing devices such as straps and the like, and wherein the carton may be reclosed after opening.

In addition, it is desirable to provide an apparatus, such as a carry handle or the like, associated with the carton to facilitate handling thereof. A combination of a smaller multi-ream container together with a carry handle, for example, is ideally suited for retail sales to home users.

SUMMARY OF THE INVENTION

The present invention comprises a carton for shipping and storing cut sheets of paper, wherein the carton holds fewer sheets of paper than conventional containers for this purpose, and is therefore lightweight and easy to handle and store. The carton is constructed for easy access to the paper for unloading it from the carton, and is particularly adapted to ship and store unwrapped sheets of paper, although it may be adapted for shipping and storing individually wrapped reams of paper.

The carton includes a base portion having at least one side wall that may be pivoted downwardly to open the carton and expose the contents for easy removal, and a lid portion engaged over the base portion to close the top of the carton and normally hold the pivoted side wall in closed position. When the lid is opened, that side wall may be pivoted downwardly to expose the paper at the top and one side to facilitate access to it.

The openable side wall enables the user to easily and quickly grasp and unload the paper stored in the carton, without the necessity of forcing the hands or fingers between the carton side walls and the contents, or turning the carton over and dumping out the contents. Moreover, the lid and openable side wall may be reclosed to protect the paper remaining in the carton.

In a preferred embodiment the carton of the invention has a built-in carry handle and is adapted to hold more than one ream of paper, but less than the five or ten reams normally placed in a conventional package. For example, the carton of the invention is adapted to hold approximately three reams of paper, resulting in a lightweight package that is easy to handle. It is not intended, however, to limit the invention to a carton for holding three reams of paper. The carton can be adapted for any quantity of paper, but is generally limited to an amount that is easy to handle and store and that the built-in carry handle can reliably support, which generally does not substantially exceed three reams. After the carton is opened, the user may simply grasp and unload as many sheets as desired, without the need to open individual reams, and the carton may be reclosed to protect the unused sheets.

In a preferred construction, the base portion comprises a bottom wall, opposite end walls, and front and back walls folded from a single unitary blank of corrugated paper. End flaps on the back wall are folded inwardly and secured to the end walls by adhesive or other suitable fastening means so that the back wall and end walls remain in an upright position. End flaps or tuck-in flaps on the front wall are folded inwardly but are not attached to the end walls. Instead, they tuck in between the end walls and paper held in the carton, whereby the front wall can be pivoted downwardly to open the front of the carton. After the desired quantity of paper is removed from the carton, the front wall can be pivoted back up to an upright position, with the tuck-in flaps tucked between the end walls and paper to re-close the carton.

The lid portion comprises a lid folded from a single unitary blank, with an insert sheet and carry handle assembled to it. The lid has a top wall, depending end flanges, and depending front and back flanges. The back flange has end flaps on its opposite ends, turned inwardly to lie inside and parallel to the end flanges but unattached to the end flanges. In the assembled carton, the lid back flange and associated end flaps are secured by adhesive or other suitable fastening means to the back wall and end walls, respectively, of the base portion. The lid front flange has a width to extend downwardly over an upper edge portion of the base portion front wall, to hold the front wall in its upright closed position when the lid is in its operative closed position. End flaps on opposite ends of the front flange are turned inwardly to lay inside and parallel to the end flanges and are attached to the end flanges by adhesive or other suitable fastening means. A glue strip on the bottom edge of the lid front flange is secured by adhesive or other suitable fastening means to the base portion front wall, and a tear strip extends along the bottom edge of the front flange between the front flange and the glue strip. With this construction, when the tear strip is removed the lid may be pivoted upwardly to expose the paper held in the carton and uncover the front wall so that it may be pivoted downwardly to facilitate access to the paper.

A carry handle is attached to the lid to facilitate carrying the carton, and comprises a flexible strap attached to a base plate that is secured beneath an insert panel placed in the lid between the lid top wall and the top sheets of paper. The flexible strap extends through aligned openings in the insert panel and lid top wall. The insert panel may comprise corrugated cardboard, or chipboard, or other suitable material.

The carton of the invention may be opened to gain access to the paper stacked inside, and reclosed to protect the remaining paper. It does not require substantial adhesive attachment between the lid and the base, or separate securing means such as straps to keep the lid assembled to the base. Further, the carton preferably holds more than one ream of paper, preferably about three reams, and because of its reduced size and weight, and the provision of a carry handle, the carton is easy to carry and store.

BRIEF DESCRIPTION OF THE DRAWINGS

A better understanding of the invention will be had upon reference to the following description in conjunction with the accompanying drawings in which like reference numerals represent like parts, and wherein.

DETAILED DESCRIPTION OF THE PREFERRED EMBODIMENTS

Figure 1:
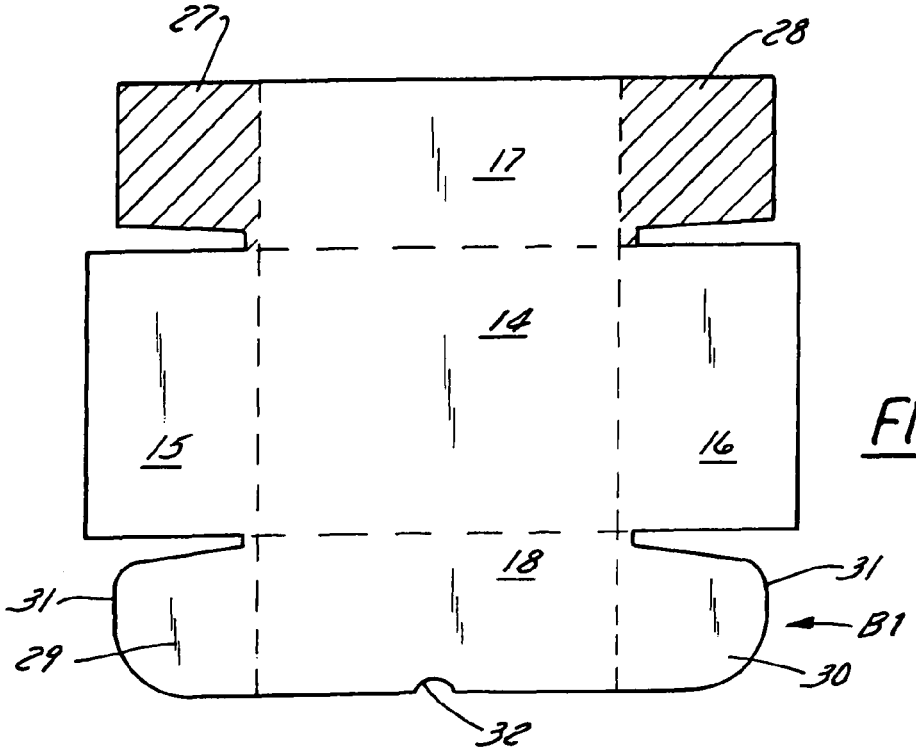
FIG. 1 is a plan view of the blank from which the carton base is formed.

A preferred carton in accordance with the invention is indicated generally at 10 in the drawings. The carton comprises a rectangularly shaped base portion 11, a lid portion 12, and a carry handle 13. The base portion has a bottom wall 14, opposite end walls 15 and 16, a back wall 17, a movable front wall 18, and an open top 19. The lid 12 is telescopically received over the open top and has a top wall 20, depending end flanges 21 and 22, a depending back flange 23, and a depending front flange 24. A glue strip 25 is joined to the bottom edge of the front flange to secure the front of the lid to the base portion front wall, and a tear strip 26 extends between the front flange and glue strip to separate the front flange from the glue strip and enable the lid to be pivoted upwardly.

Figure 6:
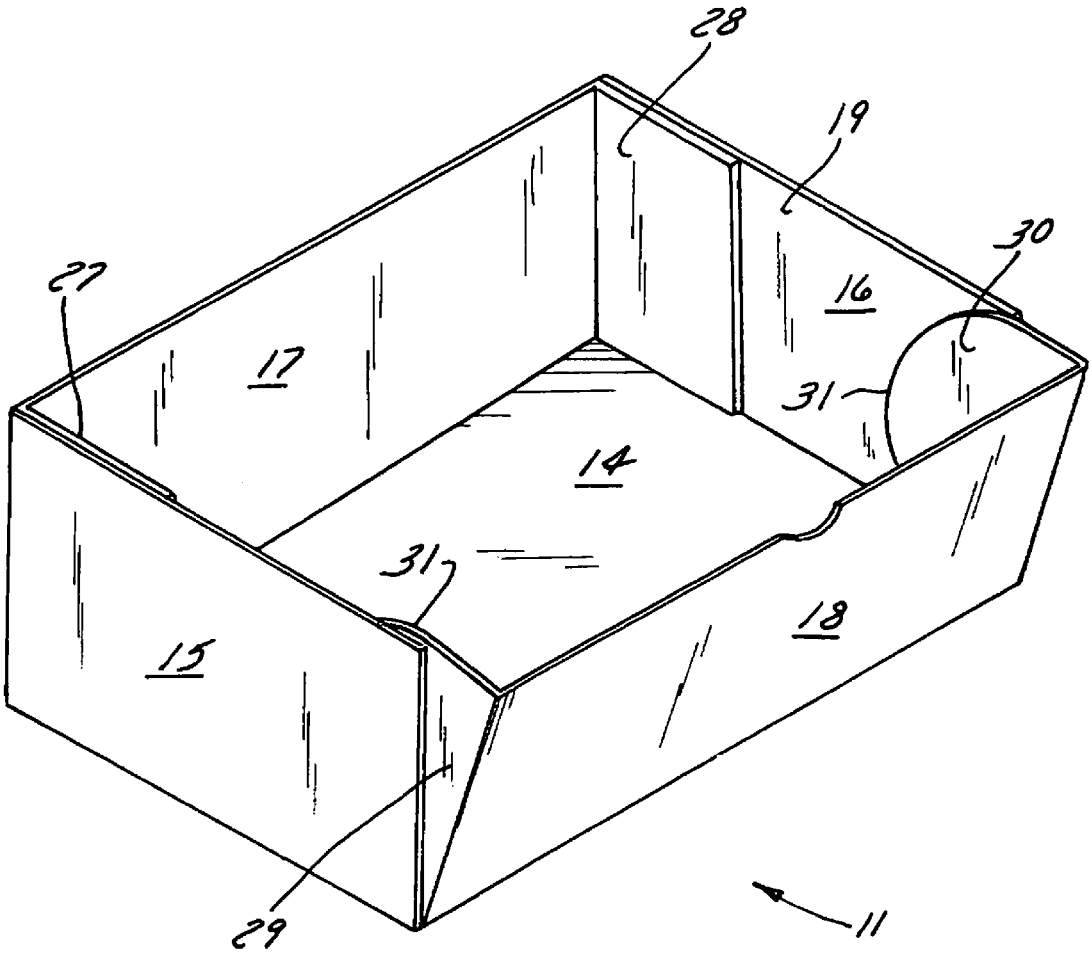
FIG. 6 is a top perspective view of the base portion of the carton of the invention, with the lid omitted and the front wall partially pivoted toward an open position.
Figure 7:
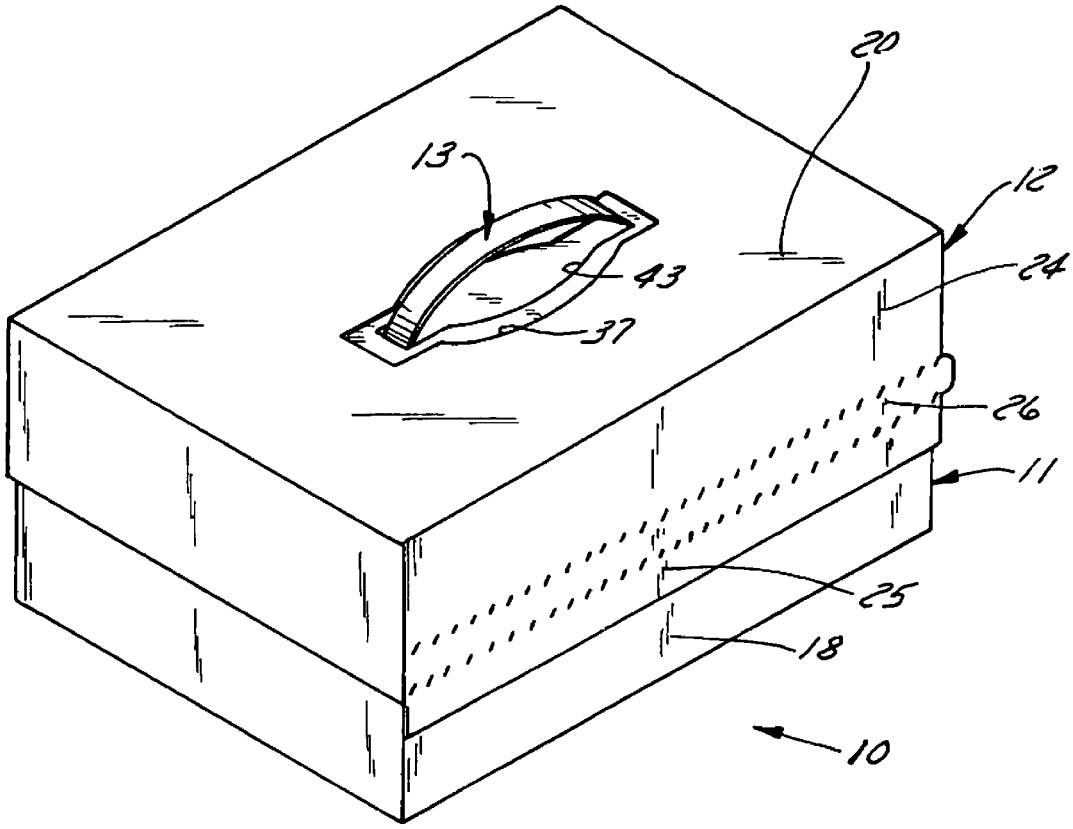
FIG. 7 is a top perspective view of a preferred package constructed in accordance with the invention.

Details of construction of the base portion 11 can be seen best with reference to FIGS. 1 and 6. A blank B1 for making the base portion 11 is illustrated in FIG. 1, and comprises bottom wall panel 14, opposite end wall panels 15 and 16 foldably joined to opposite ends of the bottom wall panel, back wall panel 17 foldably joined to a back edge of the bottom wall panel, and movable front wall panel 18 foldably joined to a front edge of the bottom wall panel. Glue flaps 27 and 28 are foldably joined to opposite ends of the back wall panel, and tuck-in flaps 29 and 30 are foldably joined to opposite ends of the front wall panel.

Assembly of the base portion 11 is seen best in FIG. 6. The glue flaps 27 and 28 on opposite ends of the back wall 17 are folded inwardly and glued or otherwise suitably fastened to the inner surface of the respective end walls 15 and 16, but the tuck-in flaps 29 and 30 on opposite ends of the front wall 18 are merely folded inwardly to lie against the inner surface of the end walls. The tuck-in flaps slide along the end walls, between the end walls and paper held in the carton, when the front wall 18 is moved between its upright and lowered pivoted positions. The tuck-in flaps may be suitably shaped, e.g., with a curvilinear free end edge 31 as shown, to facilitate entry of them into the space between the end walls and paper as the front wall is moved to its upright closed position. A finger access cut-out 32 may be provided in the upper edge of the front wall 18 to facilitate moving it downwardly, if desired.

Figure 2:
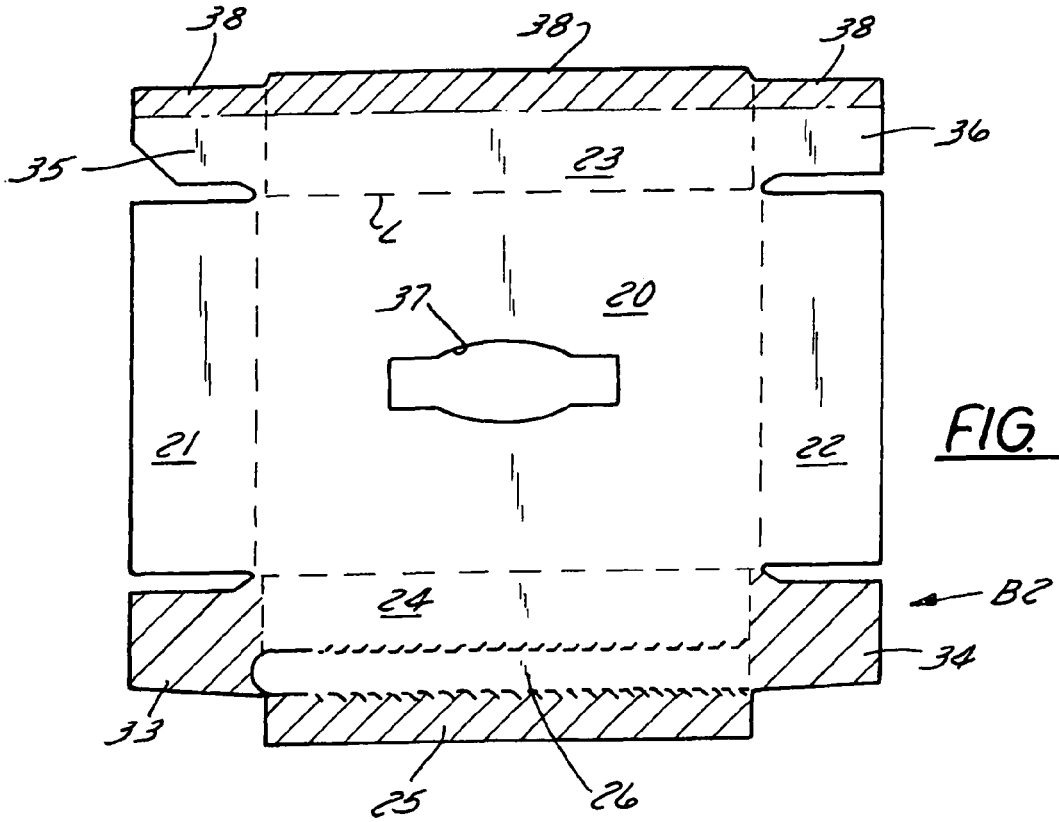
FIG. 2 is a plan view of the blank from which the lid is formed.

Details of construction of the lid portion 12 can be seen best with reference to FIGS. 2-5. A blank B2 for making the lid 12 is illustrated in FIG. 2, and comprises top wall panel 20, end flange panels 21 and 22 foldably joined to opposite ends of the top wall panel, back flange panel 23 foldably joined along fold line L to a back edge of the top wall panel, and front flange panel 24 foldably joined along a front edge of the top wall panel. Glue strip panel 25 is joined to the free edge of the front flange panel by tear strip 26 extending between the front flange and glue strip to enable separation of the front flange from the glue strip. First glue flaps 33 and 34 are foldably joined to opposite ends of the front flange panel 24, and second glue flaps 35 and 36 are foldably joined to opposite ends of the back flange panel 23. A shaped opening 37 is formed generally through the center of the top wall panel to receive the carry handle 13 as described below.

Figure 4:
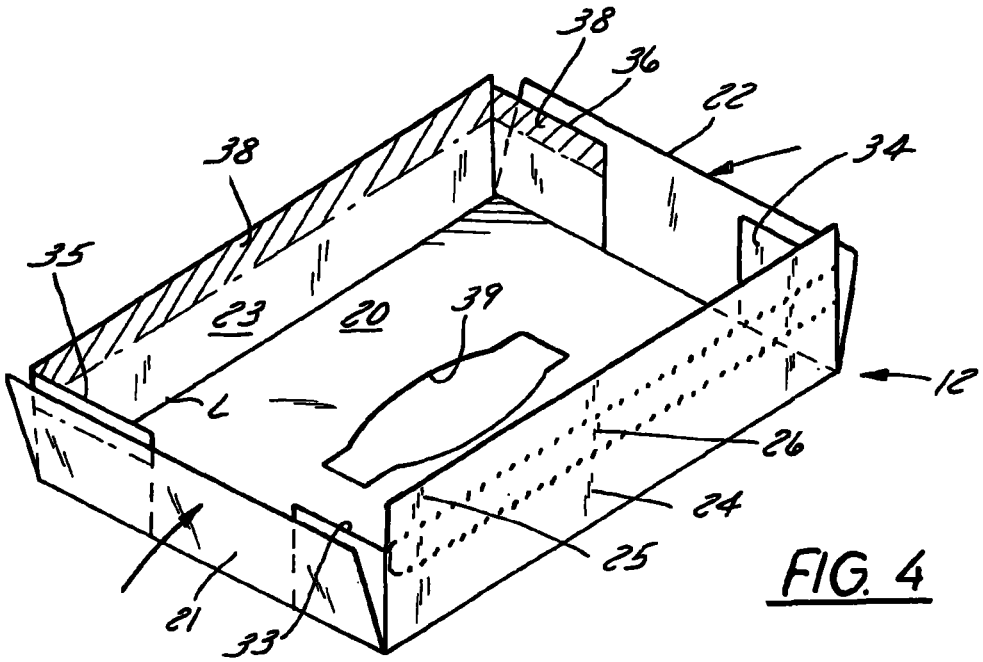
FIG. 4 is a perspective view of the lid in an inverted, upside-down position.
Figure 3:
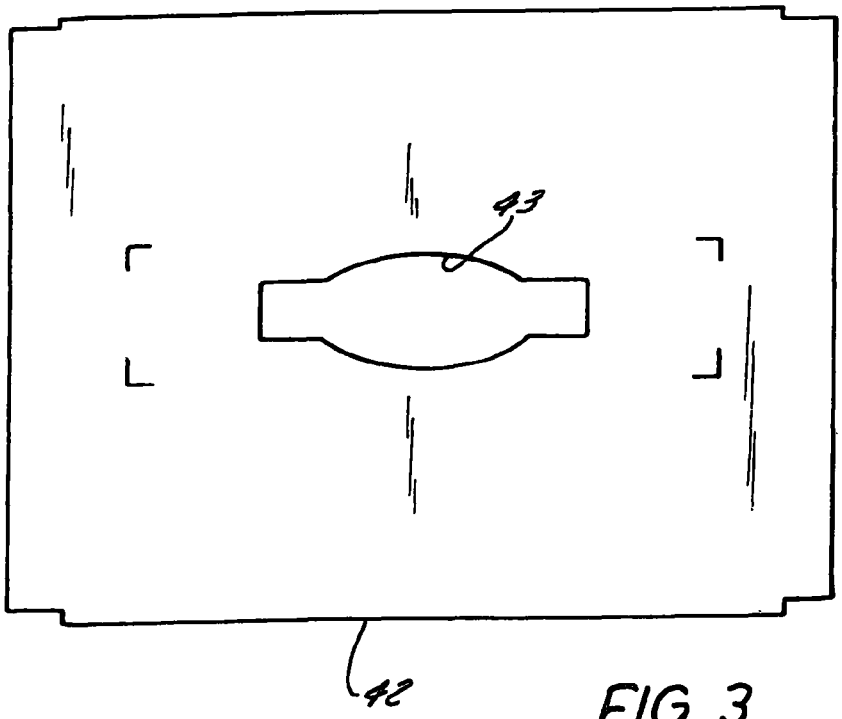
FIG. 3 is a plan view of the insert sheet used in assembling the carry handle to the lid.
Figure 8:
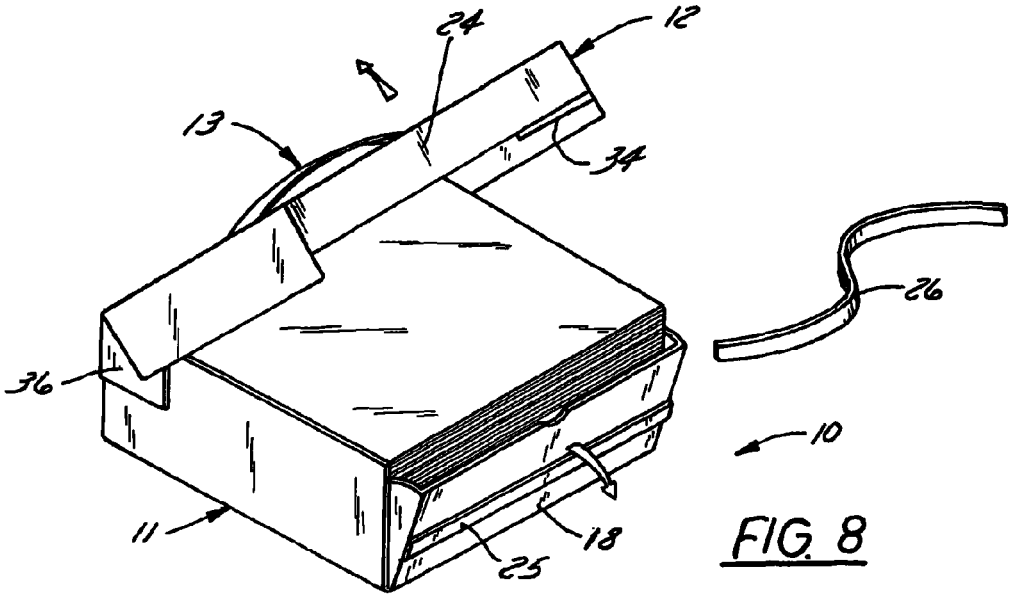
FIG. 8 is a top perspective view of the package of FIG. 7, showing the tear strip removed and the lid pivoted upwardly, with the movable front wall pivoted to a partially open position, and wherein the carton contains unwrapped sheets of paper.
Figure 9:
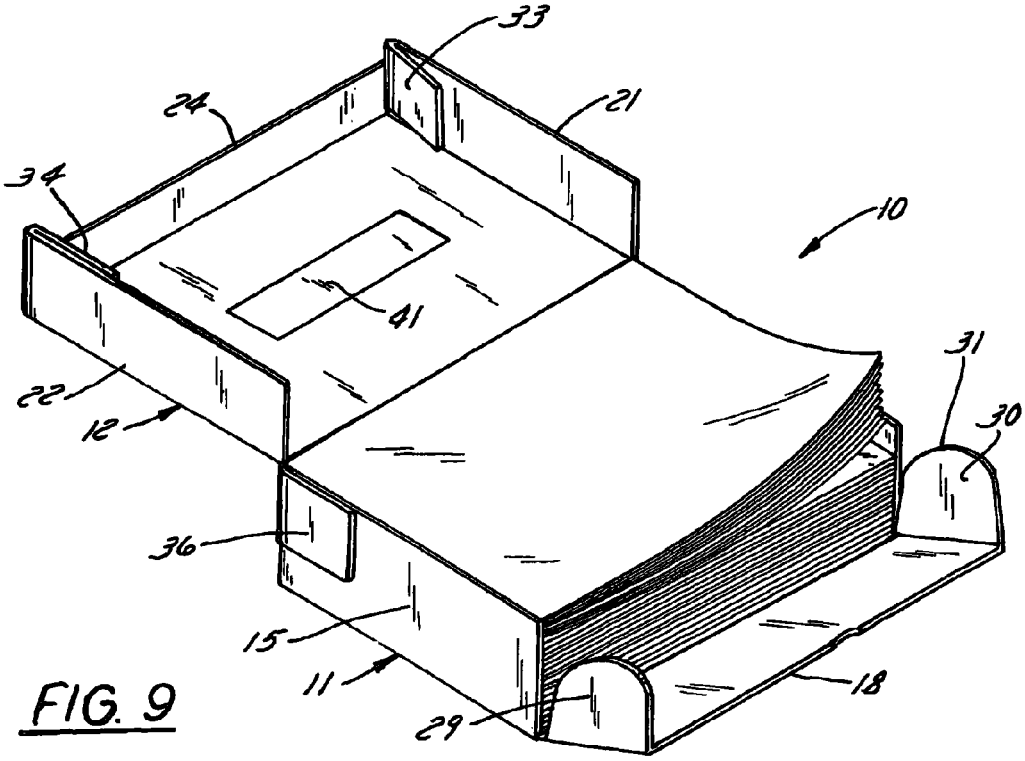
FIG. 9 is a top perspective view of the package of FIG. 8, with the lid pivoted to a fully open position and the movable front wall pivoted fully downwardly; and, FIG. 10 is a top perspective view of the package of FIG. 9, with the lid and front wall returned to their closed positions.
Figure 10:
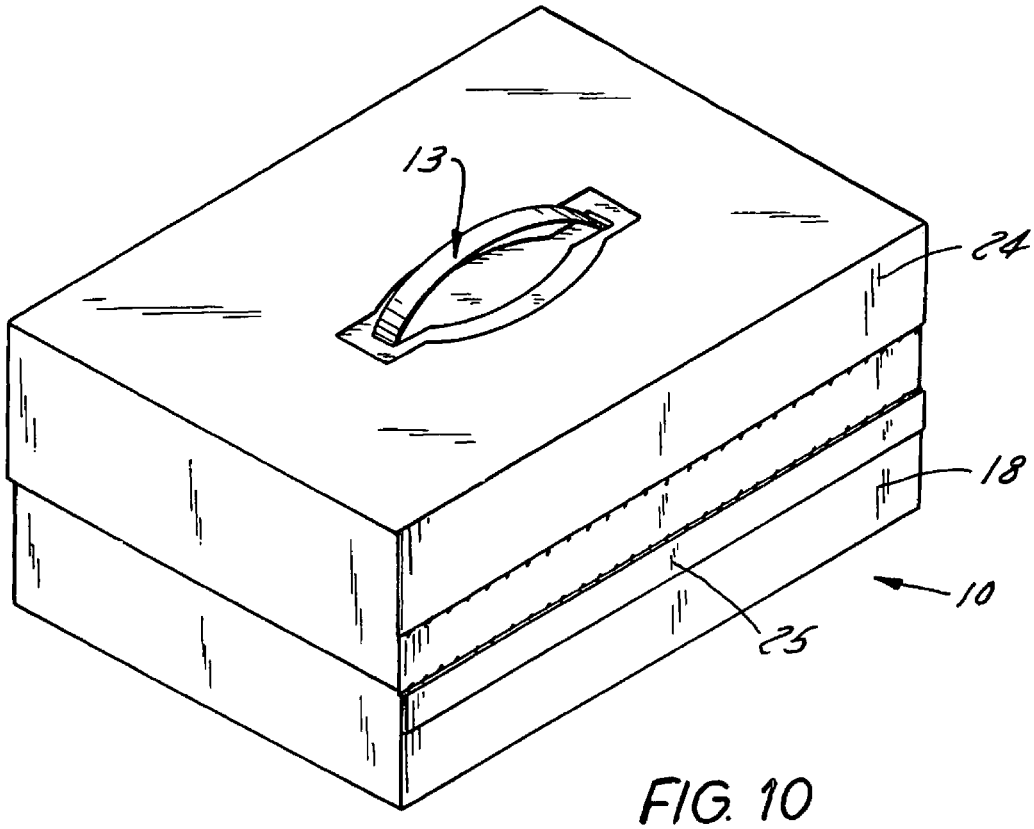

As seen best in FIG. 4, the first glue flaps 33 and 34 on opposite ends of the front flange panel 24 are secured by adhesive or other suitable fastening means against the inner surface of the respective end flanges 21 and 22, but the second glue flaps 35 and 36 are merely folded inwardly parallel to the end flanges and are not attached thereto. A band of adhesive 38 is applied along a bottom edge of the back flange panel 23 and a bottom edge of the second glue flaps 35 and 36 to attach these parts to the back wall and end walls, respectively, of the base portion when the lid is assembled to the base. The glue strip 25 also is adhesively attached to the base front wall, and with the band of adhesive 38 comprises the only adhesive attachment of the lid to the base portion. This permits the lid to be pivoted upwardly about the fold line L when the tear strip is removed to separate the front flange of the lid from the glue strip (see FIG. 8). That is, the end flanges 21 and 22, being free of attachment to the second glue flaps 35 and 36, are permitted to slide along the glue flaps and not resist upward movement of the lid as it is raised to its upward pivoted position.

Figure 5:
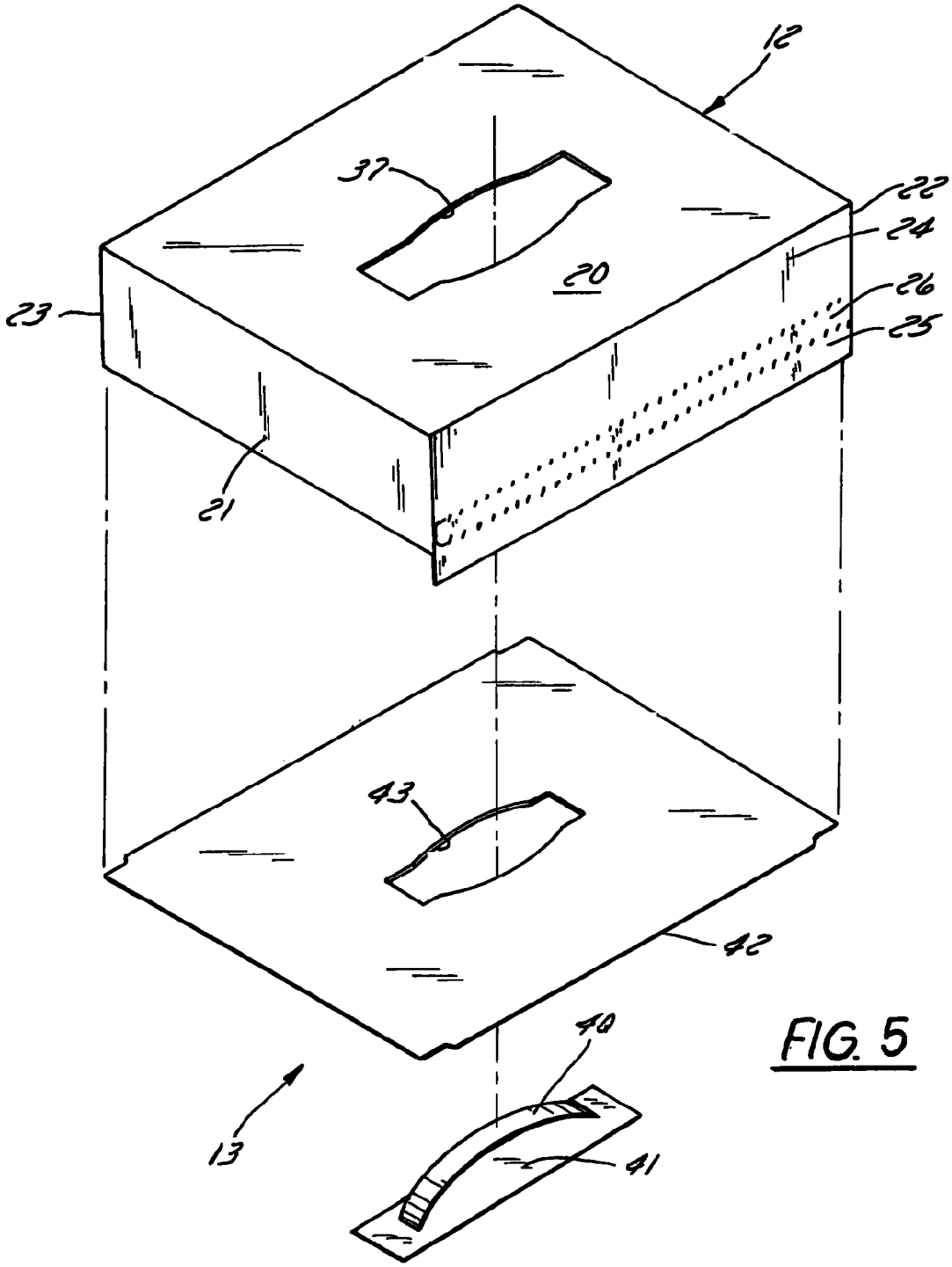
FIG. 5 is an exploded top perspective view of the lid and carry handle assembly of the carton of the invention.

As seen best in FIG. 5, the carry handle 13 includes a flexible strap 40 attached to a rectangular base plate 41 that is adhesively attached to the bottom of an insert sheet 42 sized to fit in the lid beneath the top wall, with the strap projecting through a shaped opening 43 in the sheet 42 and through the shaped opening 37 in the lid top wall. The sheet 42 may be adhesively attached to the underside of the lid top wall, or merely fit into the lid between the top wall and the paper sheets without being attached to the top wall. Either way, this construction results in a very strong carry handle.

As seen in FIGS. 7-10, the package is compact, enabling it to be easily stored under a desk or on a shelf Opening of the package is easily accomplished simply by removing the tear strip and pivoting the lid upwardly, after which the front wall can be pivoted downwardly to gain access to the paper held in the carton. After the desired amount of paper has been removed, the front wall can be returned to its upright position, with the tuck-in flaps inserted between the base end walls and the paper held in the carton, and the lid returned to its lowered position to close the package and hold the front wall in its closed position.

While the invention has been shown for holding unwrapped sheets of paper, it should be understood that it could be used for holding wrapped reams of paper, and although the preferred embodiment is designed for holding about three reams of paper, the carton could be sized for holding other quantities of paper so long as the size and weight do not exceed amounts (for example, about 20 pounds) that provide ease of handling and carrying by the carry handle.

While particular embodiments of the invention have been illustrated and described in detail herein, it should be understood that various changes and modifications may be made to the invention without departing from the spirit and intent of the invention as defined by the scope of the appended claims.

What is claimed is:

1. A carton for shipping and storing a quantity of cut sheets of paper, comprising:

a carton base portion having a bottom wall, opposed upstanding front and back walls and opposed upstanding end walls all of substantially uniform height, each joined along a bottom edge to a respective edge of the bottom wall, and an open top;

a lid telescopically engaged over the open top, said lid having a top wall with depending end flanges, a depending front flange that extends downwardly over an upper portion of the front wall when the lid is in closed position, and a depending back flange attached to the carton back wall;

a glue strip extending along a bottom edge of said lid front flange, said glue strip being adhesively attached to said base portion front wall and removably attached to said lid front flange by a tear strip;

said base portion front wall being unsecured to adjoining end walls and being pivotable about its bottom edge downwardly and away from the carton to an open position when the lid is moved upwardly away from said front wall, thereby exposing the cut paper at the top and one side to permit easy access to paper contained in the carton for rapid unloading of the paper from the carton;

said front wall having inwardly turned tuck-in flaps on opposite ends thereof which tuck into the carton in contiguous, parallel, overlapping relationship with adjacent end walls when said front wall is in closed position; and a carry handle on said lid, said carry handle comprising a flexible strap directly secured at its opposite ends to a base plate located beneath said lid top wall, and a separate insert panel between said base plate and said lid top wall, said flexible strap projecting through aligned openings in said insert panel and said lid top wall, wherein the carry handle is free of direct attachment to the lid.

2. A carton as claimed in claim 1, wherein:

inwardly turned glue flaps are on opposite ends of said lid front flange and said lid back flange, said glue flaps on said lid front flange being attached to respective said lid end flanges, and said glue flaps on said lid back flange being free of attachment to said lid end flanges.

3. A carton as claimed in claim 2, wherein:

said glue flaps on said lid back flange are attached to respective said base portion end walls.

4. A carton as claimed in claim 3, wherein:

a bottom edge of said lid back flange and a bottom edge of said glue flaps on said lid back flange are attached to said base portion back wall and end walls, respectively, by only a band of adhesive on said bottom edge of said lid back flange and said bottom edge of said glue flaps on said lid back flange.

5. A carton as claimed in claim 1, wherein:

the tuck-in flaps on said base portion front wall are relatively narrow so that they may be moved into and out of the carton without unduly disturbing the contents of the carton.

6. A carton as claimed in claim 4, wherein:

said lid top wall is foldably attached to said lid back flange along a fold line, and said lid pivots upwardly about said fold line.

7. A carton as claimed in claim 6, wherein:

said lid is attached to said base portion only by attachment of said lid back flange to said base portion back wall, attachment of said lid back flange glue flaps to said base portion end walls, and attachment of said glue strip to said base portion front wall.

8. A carton as claimed in claim 4, wherein:

said lid front flange extends downwardly over an upper edge portion of said base portion front wall to hold said front wall in closed position when said lid is in closed position.

9. A carton as claimed in claim 8, wherein:

said tuck-in flaps have free end edges, and said free end edges are shaped to facilitate insertion thereof into the carton.

10. A carton as claimed in claim 9, wherein:

said base portion back wall and end walls are integrally joined to the bottom wall, and are secured and sealed to one another at adjacent edges.

11. A carton as claimed in claim 1, wherein:

inwardly turned glue flaps are on opposite ends of said lid front flange and said lid back flange, said glue flaps on said lid front flange being attached to respective said lid end flanges, and said glue flaps on said lid back flange being free of attachment to said lid end flanges.

12. A carton as claimed in claim 11, wherein:

said glue flaps on said lid back flange are attached to respective said base portion end walls.

13. A carton as claimed in claim 12, wherein:

a bottom edge of said lid back flange and a bottom edge of said glue flaps on said lid back flange are attached to said base portion back wall and end walls, respectively;

said lid top wall is foldably attached to said lid back flange along a fold line, whereby said lid can pivot upwardly about said fold line;

said lid front flange extends downwardly over an upper edge portion of said base portion front wall to hold said front wall in closed position when said lid is in closed position;

a glue strip is on a bottom edge of said lid portion front flange, attaching said front flange to said base portion front wall, and a tear strip removably attaches said front flange to said glue strip; and said lid is attached to said base portion only by attachment of said lid back flange to said base portion back wall, attachment of said lid back flange glue flaps to said base portion end walls, and attachment of said glue strip to said base portion front wall.

14. A lid for placement over an open end of a container to close the open end, wherein said lid comprises:

a lid top wall having an opening therethrough and depending front and back flanges and end flanges;

a glue strip removably attached to a bottom edge of said lid front flange by a tear strip;

first glue flaps on opposite ends of said front flange, said first glue flaps being attached to said end flanges;

second glue flaps on opposite ends of said back flange, said second glue flaps being free of attachment to said end flanges;

a separate insert panel beneath said top wall, said insert panel having an opening therethrough in alignment with the opening through the top wall; and a flexible strap directly attached at opposite ends to only a base plate beneath said insert panel, said strap projecting through said aligned openings in said insert panel and top wall and forming a carry handle, wherein the insert panel, base plate and carry handle are free from direct attachment to the lid.

* * * * *